US007056114B2

(12) United States Patent
Brooker

(10) Patent No.: US 7,056,114 B2
(45) Date of Patent: Jun. 6, 2006

(54) FLAME ARRESTOR WITH REFLECTION SUPPRESSOR

(75) Inventor: Dwight E. Brooker, Skiatook, OK (US)

(73) Assignee: The Protectoseal Company, Bensenville, IL (US)

( * ) Notice: Subject to any disclaimer, the term of this patent is extended or adjusted under 35 U.S.C. 154(b) by 427 days.

(21) Appl. No.: 10/664,306

(22) Filed: Sep. 16, 2003

(65) Prior Publication Data

US 2004/0065449 A1 Apr. 8, 2004

Related U.S. Application Data

(63) Continuation of application No. 10/108,281, filed on Mar. 27, 2002, now Pat. No. 6,644,961.

(60) Provisional application No. 60/279,213, filed on Mar. 27, 2001.

(51) Int. Cl.
*F23D 14/82* (2006.01)
*F23D 14/12* (2006.01)

(52) U.S. Cl. ..... 431/346; 431/328

(58) Field of Classification Search ..... 431/346, 431/328, 202; 48/192; 60/39.11
See application file for complete search history.

(56) References Cited

U.S. PATENT DOCUMENTS 1,681,698 A 8/1928 Brooks
2,420,599 A 5/1947 Jurs
3,748,111 A 7/1973 Klose
4,909,730 A 3/1990 Roussakis et al.
5,415,233 A 5/1995 Roussakis et al.
6,644,961 B1 * 11/2003 Brooker ..... 431/346

FOREIGN PATENT DOCUMENTS

CA 1057187 6/1979

OTHER PUBLICATIONS

Perry's Chemical Engineers' Handbook, 7th Ed. 1997 pp. 26-38 to 26-43.

* cited by examiner

*Primary Examiner*—Alfred Basichas
(74) *Attorney, Agent, or Firm*—Olson & Hierl, Ltd.

(57) ABSTRACT

A combination of a flame arrestor with a reflection suppressor is provided which not only arrests an advancing flame front, but also suppresses or mitigates a reflection wave that is generated by a pressure wave that passes through the combination and continues on to a pipe restriction what generates a reflection wave that proceeds back to the combination. At the combination, the reflection suppressor suppresses and/or mitigates the reflection wave, thereby avoiding a heightened pressure in the combination that could cause a re-ignition and a new flame front and pressure front. The reflection suppressor has a tapered profile that permits a pressure wave to pass along and past the reflection suppressor as it leaves the combination but that impedes and mitigates a returning reflection wave produced by the pressure wave striking a pipe restriction and causing such a returning reflection wave.

6 Claims, 4 Drawing Sheets

FLAME ARRESTOR WITH REFLECTION SUPPRESSOR

PRIORITY CLAIM

This application is a continuation of application Ser. No. 10/108,281, filed Mar. 27, 2002 now U.S. Pat. No. 6,644,961, which application claims priority of U.S. Provisional Patent Application Ser. No. 60/279,213, filed Mar. 27, 2001.

FIELD OF THE INVENTION

This invention relates to flame arrestors equipped with reflection suppressors.

BACKGROUND OF THE INVENTION

Flame arrestors are passive devices designed to prevent propagation of gas flames through pipelines. A flame arrestor incorporates a permeable barrier known as an element which is usually a matrix of metallic, ceramic or mixed materials that define a permeable barrier containing narrow channels. An element removes heat and free radicals from a flame at a rate which is fast enough to quench the flame and to prevent reignition of the hot gas on the protected side (downstream relative to the direction of flame propagation along a pipe) of the arrestor.

A flame arrestor is located in a pipeline carrying a flammable gas, and the design of a flame arrestor can vary greatly depending upon application, location and use conditions. For example, a best design for a particular installation may take into account flow resistance, maintainability and cost.

For purposes of evaluating efficacy of a particular flame arrestor for particular flame arrestor applications, various testing protocols have been developed that aim to address most adverse conditions encountered. In, for example, the case of marine vapor control systems in the United States, the testing and application of flame arrestors is regulated by the U.S. Coast Guard.

A flame arrestor can be used to arrest deflagrations and detonations. A deflagration is a combustion wave propagating at less than the speed of sound as measured in unburned gas immediately ahead of the flame front. Flame speed relative to unburned gas is typically 10–100 m/s (meters per second), but, owing to expansion of hot gas behind the flame, several hundred meters per second may be achieved relative to a pipe wall. Although the pressure peak coincides with the flame front, a marked pressure rise precedes it, so that the unburned gas is compressed as the deflagration proceeds, depending upon flame speed and available vent paths. The precompression of gas ahead of the flame front establishes the gas conditions in the arrestor when the flame enters it and hence affects both the arrestment process and the maximum pressure generated in the arrestor body.

As a deflagration travels through piping, its speed increases due to flow-induced turbulence and compressive heating of unburned gas ahead of the flame front. At a flame speed approaching sonic velocity, a deflagration-to-detonation transition (DDT) can occur with associated abnormally high velocities and pressures. At the instant of transition, a transient state of overdriven detonation is achieved and persists for a few pipe diameters. After the decay of such conditions, a stable detonation state is attained. A detonation is a combustion-driven shock wave propagating at the speed of sound, as measured in the burned gas immediately behind the flame front. Stable detonations propagate at sonic velocities relative to an external fixed point. A wave is sustained by chemical energy released by shock compression and ignition of unreacted gas. The flame front is coupled in space and time with the shock front, with no significant pressure rise ahead of the shock front.

The high velocities and pressures associated with detonations require special element design to quench the high-velocity flames plus superior arrestor construction to withstand the associated impulse loading. In practice, this entails narrower and/or longer element channels plus bracing of the element facing.

The problem of flame arrestment, either of deflagrations or detonations, depends on the properties of the gas mixture plus the initial pressure. Since gas mixture combustion properties cannot be quantified for direct use in flame arrester selection, flame arrester performance must be demonstrated by realistic testing.

A severe deflagration arrestment test involves placing a restricting orifice behind the arrestor (that is, upstream relative to the direction of wave propagation). Such a restriction produces a so-called reflection wave that travels back to the flame arrestor from the restriction and increases the degree of precompression. Such "restricted end" deflagration testing constitutes a severe deflagration arrestment test, yet such testing is believed to represent an operating environment that can exist in fact from various conditions, such as when, for example, a closed or partially closed valve in a pipe is located upstream from a functioning arrestor in the pipeline. Such testing has demonstrated that arrestors capable of stopping even overdriven detonations may fail under restricted end deflagration test conditions.

The art of flame arrestors needs improved apparatus and methods for achieving arrestment in environments where reflection waves can be generated upstream relative to the direction of wave propagation and be propagated back to a flame arrestor. The present invention provides such improvements.

SUMMARY OF THE INVENTION

More particularly, this invention is directed to a combination of a flame arrestor with a reflection suppressor, and to a process for using same.

The invention aims to control, including minimize and suppress, reflection waves produced in a pipeline.

The invention can be practiced with various types of flame arrestors, and is suitable for use in various flame arrestor applications. The reflection suppressor that is provided in accord with the present invention is located adjacent to an interior end region of an arrestor in a common housing. This end region is chosen so as to be an end of the arrestor that is downstream relative to the direction of flame and pressure wave propagation, but that is upstream relative to the direction of reflection wave propagation.

The flame arrestor can be either of the deflagration arresting type or of the anti-detonation (or so-called detonation arresting) type. A detonation flame arrestor may also be usable as a deflagration flame arrestor. Preferably, in the practice of this invention, the inventive combination employs a flame arrestor of the detonation type and that has opposite end portions that adapt the combination to be mounted in a pipeline.

Preferably, in the inventive combination, a reflection suppressor is provided adjacent each opposite end portion of the combination, whereby the combination is adapted to suppress a reflected wave that reaches either end portion of the combination.

The reflection suppressor employed in the combination is a body having tapered sidewalls. The body has a longitudinal length such that it is axially positionable in an end region of a housing that also holds the flame arrestor, and the body is centered and longitudinally adjacent to the flame arresting housing. The tapered body has an apex end portion and a base end portion that is longitudinally spaced from the apex end portion. In a housing, the base end portion has a substantially larger cross-sectional area than the apex end portion. The longitudinal length of the tapered body is preferably such that the base end portion is located approximately adjacent to an outlet aperture of the common housing while the apex end portion is located approximately adjacent to an end region of the flame arrestor. Preferably, the flame arrestor is located in a mid-region of the common housing.

Preferably the combination is easy to assemble and maintain.

Other and further aims, purposes, objects, features, advantages, embodiments and the like will be apparent to those skilled in the art from the present specification taken with the accompanying drawings and the appended claims.

DETAILED DESCRIPTION

Figure 1:
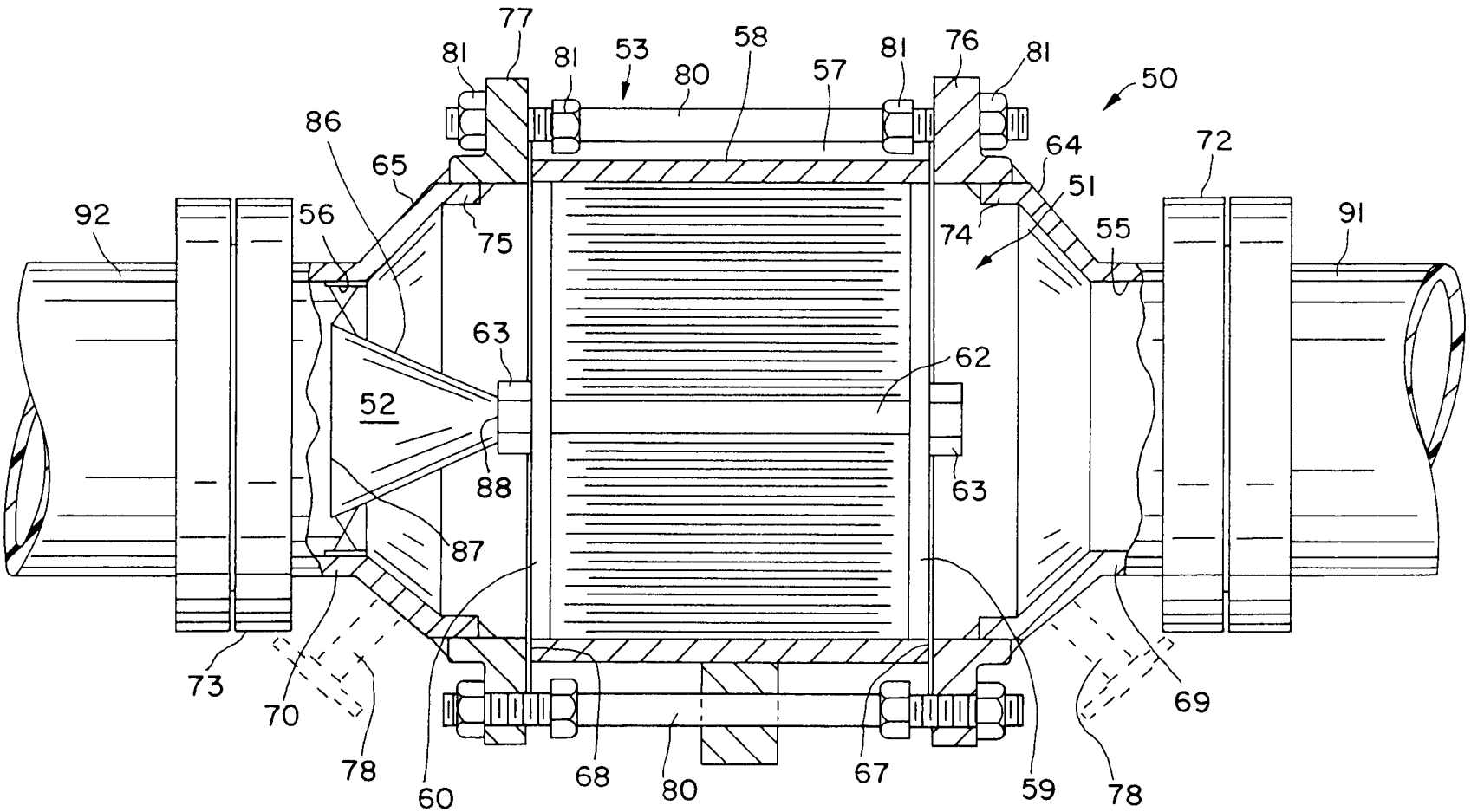
FIG. 1 is a longitudinal, medial, partial sectional view through an embodiment of the inventive combination of a flame arrestor with a reflection suppressor, some parts being broken away and some parts being shown in section.
Figure 2:
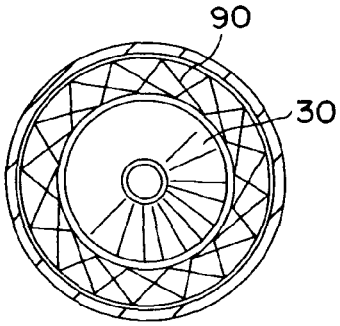
FIG. 2 is a vertical sectional view taken along the line II—II of FIG. 1.

Referring to FIGS. 1 and 2, there is seen an illustrative embodiment 50 of the inventive combination of a detonation flame arrestor 51 with a reflection suppressor 52. The combination 50 is comprised of metal components, preferably steel or steel alloy. The combination 50 employs a common housing 53 for the flame arrestor 51 and for the reflection suppressor 52.

The housing 53 is cross-sectionally circular and axially elongated, and has a generally circular aperture 55 and 56 defined at each respective opposite end thereof. The mid-region 57 of the housing 53 is diametrically enlarged, has a generally uniform diameter, and has side wall portions defined by a circumferentially extending sleeve 58. Transversely across but within each respective opposite end 67, 68 of sleeve 58 (and mid-region 57) a circular, apertured retaining wall 59 and 60, respectively, is located. The walls 59 and 60 are supported and connected by an axially extending elongated bolt 62 whose respective opposite ends are each threadably associated with a nut 63.

The apertured walls 59 and 60 can be comprised of plate stock, but, preferably are alternatively fabricated of cross bars that are welded together at abutting and cross-over regions. Other constructions can be employed, as those skilled in the art appreciate.

Longitudinally adjacent each respective opposite end 67, 68 of sleeve 58 is located a frusto-conical section 64 and 65 of housing 53. Each section 64 and 65 provides a longitudinally tapered region that declines in cross-sectional area proceeding from each opposite end 67, 68 of sleeve 58 to an adjacent aperture 55, 56, respectively. In the region of each aperture 55, 56, each section 64, 65 defines a terminal cylindrical portion 69, 70, respectively, and each cylindrical portion 69, 70 is joined at its outer end, by welding or the like, to a pipe connecting flange 72, 73, respectively. The sleeve 58 adjacent end portion of each frusto-conical section 64, 65 terminates in an integrally associated, longitudinally short, cylindrical flange 74, 75, respectively. Outer surface portions of each flange 74, 75 are joined preferably by welding to a sleeve abutting flange 76, 77, respectively.

During assembly of the combination 30, each flange 76, 77 is longitudinally abutted against an opposite end 67, 68 of the sleeve 58. In aligned relationship with one another, apertures (not shown) defined in the outstanding portions of each respective flange 76, 77 have extended therethrough a plurality of circumferentially preferably equally spaced tie rods 80. The respective opposite ends of the tie rods 80 are threadably associated with nuts 81, so that longitudinal compressive force exerted by the rods 80 and their associated nuts 81 hold the housing components in assembled relationship.

Positioned between the walls 59, 60 within the sleeve 58 is a fill of crimped steel plates or the like (not detailed but conventional). Various flame arrestor fill media are known to the prior art and can be employed, including fill structures having a honeycomb configuration (in cross section), packed steel or ceramic spheres (or other spherical media) parallel or stacked crimped metal plates, stacked wire mesh (such as disclosed in U.S. Pat. No. 4,909,730), and the like.

The walls 59, 60 taken with the fill material can be considered to comprise the "element" of a flame arrestor, as those skilled in the art will readily appreciate. The element is porous and adapted for the passage of a gas therethrough that is flowing a rate within a predetermined range in the pipeline across which the inventive combination 50 is connected. The design of the element varies from one intended installation to another. Also, the element design may be influenced and sometimes controlled by the criteria specified in a test protocol to which the element has been subjected (or could be subjected) and passed. As those skilled in the art will appreciate, many variations in the design of a particular element are possible and are used. It is an important feature and advantage of the present invention that the reflection suppressor can be associated with a flame arrestor virtually without regard to the structure or operating characteristics of an element without detracting from the capacity of the reflection suppressor to reduce or eliminate the effect of a reflection wave upon the element.

In the frusto-conical section 65 of the housing 53, the reflection suppressor 52 is located. The reflection suppressor 52 has side wall portions 86 that extend between a base portion 87 and an apex portion 88 thereof. The reflection suppressor 52 has a longitudinal or axial length 89 (see FIG. 5) that is shorter than the distance between the orifice or aperture 56 and the adjacent wall 60 of the element. Also, the reflection suppressor 53 has a cross-sectional area along its length between the base portion 87 and the apex portion 88 that generally declines with increasing distance from the base portion 87. Further, the base portion 87 has a cross-sectional area that is less than the cross sectional area of the orifice or aperture 56. While the reflection suppressor 52 has side wall portions 86 that are here conically tapered which is preferred, a reflection suppressor, as below described, can have other side wall configurations, if desired.

Mounting means is provided for mounting (including holding and supporting) the reflector suppressor 52 in the frusto-conical section 65. The reflection suppressor 52 is preferably (and as shown) centrally positioned in the section 65. The base portion 86 is located adjacent to the orifice 56 in section 65. In embodiment 50, the mounting means is achieved by mounting the apex portion 88, by welding or the like, to the adjacent nut 63 and by positioning a spider 90 (shown in FIGS. 1 and 2) circumferentially about side wall portions 86 adjacent to the base portion 87. The spider 90 is sized to fit in the neck region of the terminal cylindrical portion 65. However, various convenient alternative mounting means may be employed for a reflection suppressor as those skilled in the art will readily appreciate.

Optionally, the housing 53 is provided with fittings 78 for drains, pressure taps, or temperature probes.

In the combination 50, normal gas flow in a pipeline to which the combination 50 is connected can proceed in either direction (relative to the apertures 55 and 56) through the housing 53, including through the element as defined by walls 59, 60 and the fill therebetween, and around the reflection suppressor 52. However, when a flame front and associated pressure wave occur in the associated pipeline at a location at a distance from the combination 50, the flame front and associated pressure wave propagate towards the combination 50 and reach the combination 50 through the input pipe 91, the combination becomes operational. Owing to the design of the detonation flame arrestor 51, the flame front is suppressed upon reaching and entering the arrester 51 owing to the relationship between the passageways through the element and the heat sink capacity of the element. However, the pressure wave passes through the element and the arrestor 51 and around the reflection suppressor 52 and moves into and onwards in the output pipe 92. Upon reaching a restriction (not shown in FIG. 1) in the output pipe 92, a reflection pressure wave is generated that moves in the opposite direction and so travels back in the output pipe 92 to the combination 50.

As those skilled in the art will appreciate, and as the results of various studies and tests have ascertained and confirmed, a restriction in a pipe can be caused by various factors and pipe discontinuities, such as a bend in the pipeline, a coupling, a valve that perhaps is not fully closed or open, and other flow path changes. Theoretically, if the pressure wave encounters no restriction, then no reflection pressure wave is produced. When a reflection pressure wave is produced and enters a flame arrestor, a sudden pressure increase occurs therein causing a so-called over-pressure situation within the flame arrestor 51, which can result in a re-ignition and propagation of a new flame front and pressure front outwardly from the region of the flame arrestor in the pipeline.

The reflection suppressor 52, when the reflection wave reaches the combination 50, restricts the flow of the high pressure reflection wave front back into the housing 53 of the combination 50. The reflection wave is either reflected back harmlessly into the output pipe 92 or the pressure is absorbed by the reflection suppressor 52 and the adjacent portions of the housing 53.

By retaining the base portion 87 in an open configuration, some energy of the reflection wave is resultingly absorbed by the open base upon reaching the reflection suppressor 85.

Figure 3:
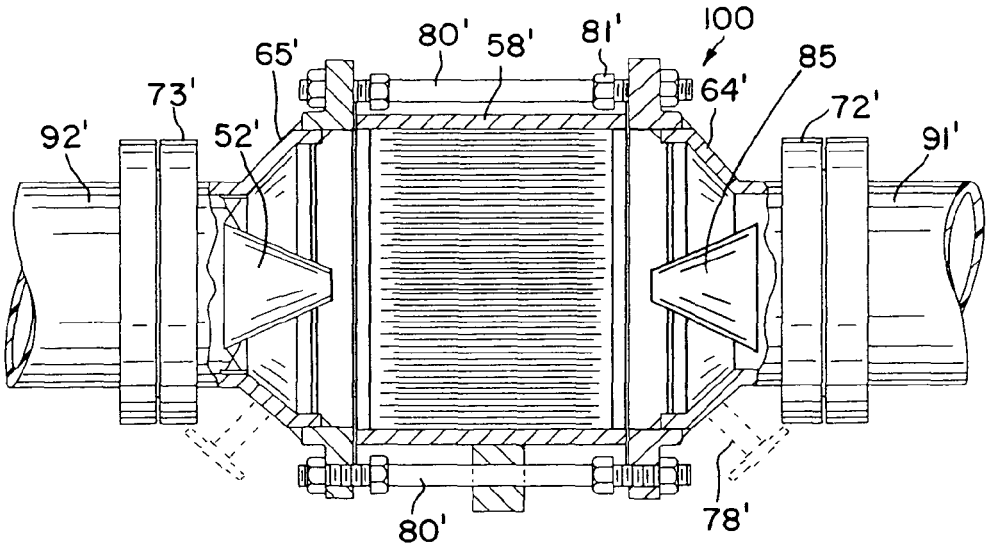
FIG. 3 is a view similar to FIG. 1 but showing the combination with two reflection suppressors.

Since it is not always possible to predict that a wave front and associated pressure wave will approach a combination 50 from only one direction along the associated pipeline, it is advisable and indeed preferred to provide a combination 100 that is similar to the combination 50 but that contains a second reflection suppressor 85 located in the frusto-conical section 64, as illustrated in FIG. 3, where components similar to those in FIGS. 1 and 2 are similarly numbered but with the addition of prime marks thereto for convenient identification purposes. The reflection suppressor 85 is similar to the reflection suppressor 52, but is oriented in a reverse direction, and operates similarly but with gases moving in an opposite direction.

By suppressing or diverting a reflection wave, the reflection suppressor avoids potentially catastrophic results in the region of the combination 50.

Figure 4:
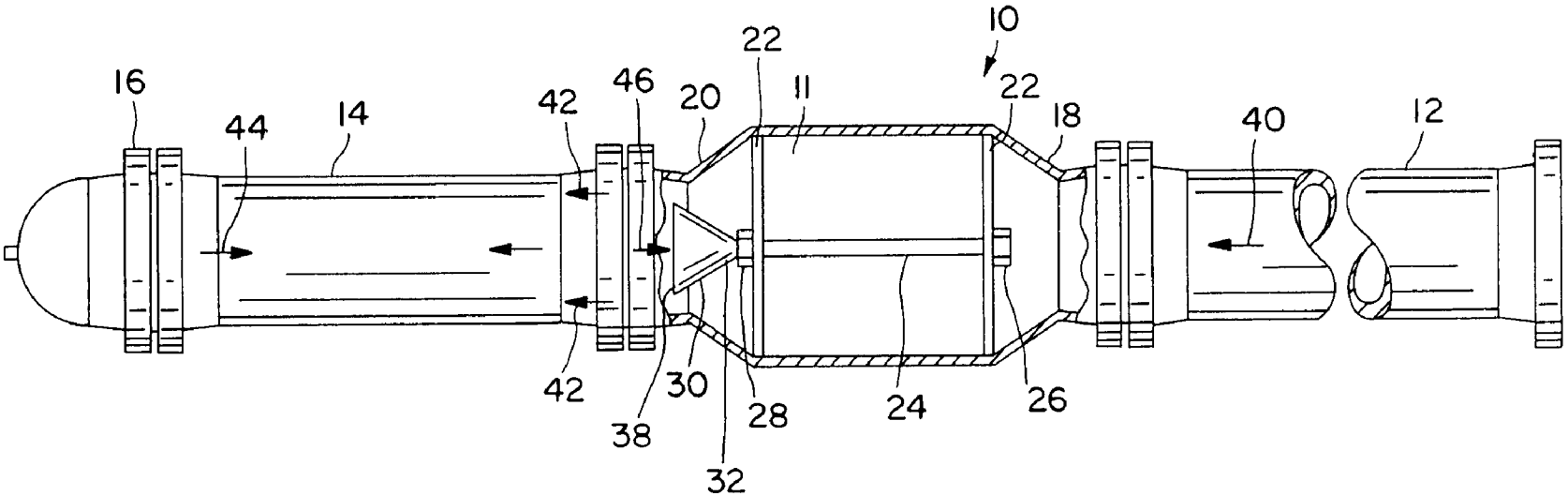
FIG. 4 is a diagrammatic view of another embodiment of a combination of a flame arrestor with a reflection suppressor; some parts being broken away and some parts being shown in section.

Another embodiment of a combination of flame arrestor 10 and reflection suppressor 30 is illustrated in FIG. 4, this arrangement being similar to that of FIG. 1, but is adapted for testing in accord with a test protocol.

This embodiment has the combination associated with an inlet pipe 12 and an outlet pipe 14 in a pipeline. The configuration shown in FIG. 4 includes a restricted end 16 on outlet pipe 14. It is understood, however, that flame arrestors such as flame arrestor 10 can be installed in multiple pipeline configurations. Restricted end 16 is depicted in FIG. 4 for convenience in describing a reflective pressure front (below). Inlet pipe 12 is secured to the inlet side 18 of the flame arrestor 10 in a known manner. Likewise, outlet pipe 14 is secured to the outlet side 20 of the flame arrestor in a known manner.

The precise internal configuration of flame arrestor 10 varies with the type of fill media inserted which may be determined by the desired application. It is understood that known internal configurations for a flame arrestor 10 are acceptable for the present invention, such as for example, the flame arrestor apparatus disclosed in U.S. Pat. No. 5,415,233. Additional known flame arrestor fill media include structures having a honeycomb configuration (in cross section), packed steel or ceramic spheres (or other spherical media), parallel or stacked plates, stacked wire mesh (such as disclosed in U.S. Pat. No. 4,909,730) or the like. It is understood that flame arrestor 10 of FIG. 4 and of the present invention could be configured to include such fill media, and other known configurations, within its internal cavity 11.

Flame arrestor 10 as depicted in FIG. 4 includes a pair of perforated or apertured end plates, each 22, which support a central bolt 24 secured by nuts 26 and 28 for the purpose of description herein. However, it is understood that the combination of the invention utilizes a common housing for the flame arrestor and the reflection suppressor. In place of end plates 22, other apertured wall means can be used such as welded cross bars or the like. Also, in place of central bolt 24, and nuts 26 and 28 other mounting and supporting arrangements can be used.

Flame arrestor 10 includes in the outlet end 20 of the common housing a reflection suppression device 30 of the present invention. Reflection suppressor 30 is positioned on the outlet side 20 of flame arrestor 10 between the fill media contained within internal cavity 11 and outlet pipe 14. In a construction such as depicted in FIG. 4 wherein the flame arrestor 10 includes a center bolt 24, reflection suppressor 30 is fitted with a nut 28 which threads onto center bolt 24 in the same manner as bolt 26 threads onto the opposite end of center bolt 24. In an embodiment where a center bolt is omitted, reflection suppressor 30 may be affixed to the outlet side 20 of flame arrestor 10 by other known means, most commonly welding.

Figure 5:
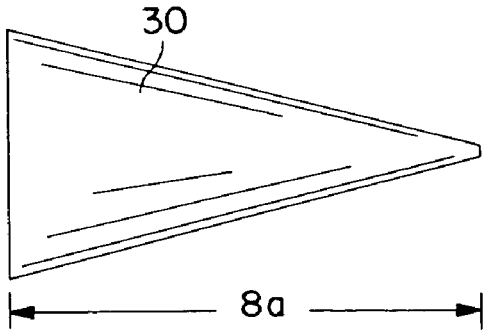
FIG. 5 is a side elevational view of the reflection suppressor such as employed in the embodiments of FIGS. 1 and 4.
Figure 6:
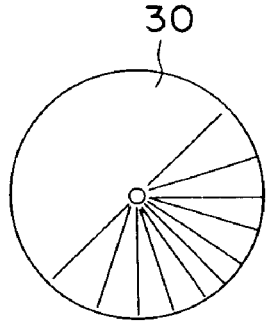
FIG. 6 is an apex end elevational view of the reflection suppressor of FIG. 5.

Referring to FIGS. 5 and 6, views of the reflection suppressor 30 are provided. As shown, reflection suppressor 30, in its preferred embodiment is of a conical or frusto-conical longitudinal geometry. The nut 28 is secured to the tapered end (vertex) of the reflection suppressor 30. Nut 28 may be secured by any known means, but is preferably welded thereon. As stated above, it is understood that reflection suppressor 30 may be configured without nut 28 and welded directly to the end plate 22 on the outlet side of flame arrestor 10 or affixed directly to the fill media contained within internal cavity 11.

Figure 7:
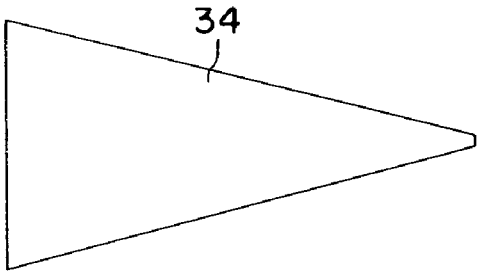
FIG. 7 is a side elevational view similar to FIG. 5 but showing an alternative embodiment of a reflection suppressor.
Figure 8:
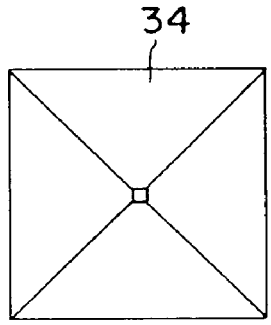
FIG. 8 is an apex end elevational view of the reflection suppressor of FIG. 7.

FIGS. 7 and 8 show an alternate reflection suppressor 34 of the present invention. In this alternate preferred embodiment, reflection suppressor 34 has a pyramidal geometry. As with the embodiment 30, the alternate embodiment 34 of FIG. 4 is secured to nut 28 in the manner described above in embodiment 30.

Figure 9:
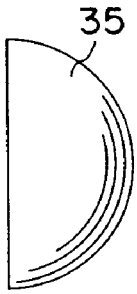
FIG. 9 is a side elevational view similar to FIG. 5 but showing an alternative embodiment of a reflection suppressor.
Figure 10:
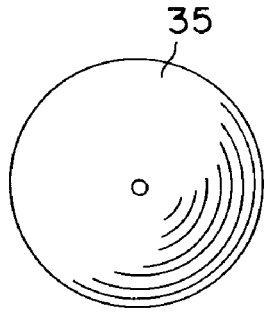
FIG. 10 is an apex end elevational view of the reflection suppressor of FIG. 9.

FIGS. 9 and 10 show an alternate reflection suppressor 35 which has a hemispherical geometry.

The geometries of the present embodiments of FIGS. 5, 7 and 9 can each be considered to include a vertex 32, an altitude 36, and a base 38.

The side walls of a reflection suppressor 30, 34 or 35 can be, if desired, porous or perforated. The bases of such reflectors can be continuous, porous, perforated or open.

Figure 11:
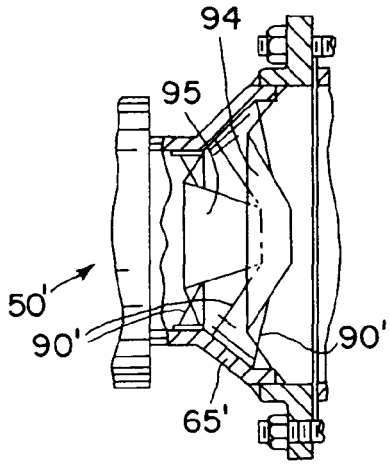
FIG. 11 is a diagrammatic, fragmentary vertical sectional view through an end region of an inventive combination that is similar to the FIG. 1 embodiment but that illustrates an alternative embodiment that incorporates two reflection suppressors in an inward end region of the common housing.

A reflection suppressor in the inventive combination may incorporate, if desired, two successive, serially arranged and centrally positioned tapered bodies that are preferably each conically configured, such as the bodies 94 and 95 in the fragmentary alternative embodiment shown in FIG. 11. Both bodies 94 and 95 are located in a single end region, such as in frusto-conical section 65' of the housing 53' combination 50' illustrated in FIG. 11 and both bodies are frusto-conically configured. The outward body 95, against which an advancing reflection wave first impinges, preferably has smaller dimensions than the inward body 94 against which the advancing reflection wave secondarily impinges. To mount the bodies 94 and 95, a plurality of spiders 90' are illustratively employed, with the apex of the body 95 being illustratively received in and mounted across the base of the body 94; however, alternative arrangements can be employed.

The significance of the geometry of a reflection suppressor, such as suppressor 30, is next described. Referring to FIG. 4 and as stated above, reflection suppressor 30 is positioned on the outlet side 20 of flame arrestor 10 such that vertex 32 is positioned adjacent the fill media contained within internal cavity 11 and base 38 is positioned toward outlet pipe 14 in the direction of flow within the pipeline. The configuration (shape) and position of reflection suppressor 30 is important. The shape of reflection suppressor 30 may be such that the vertex end 32 does not unduly impede the gas flow through and away from flame arrestor 10 in the direction of flow in the pipeline, yet restricts the flow in the opposite direction back into the flame arrestor 10 from the outlet side 20.

In other words, the size of base 38 and the length of altitude 36 are such that reflective wave fronts traveling counter-flow relative to an initiating pressure wave within outlet pipe 14 are restricted from re-entering flame arrestor 10 through outlet side 20. The shape, the reflection suppressor which is preferably conical preferably offers little or no flow restriction to a pressure wave leaving the flame arrestor but preferably offers a significant flow impediment or restarting effect on a reflection wave that would, but for the reflection suppressor enter the flame arrestor. As a reflection suppressor configured, a pressure front which may cause flame arrestor 10 to fail is restricted. Although the conical geometry of FIG. 5 and the pyramidal geometry of FIG. 7 and the hemispherical geometry of FIG. 9 may be considered to be preferred embodiments of reflection suppressors, it is understood that other geometries are contemplated provided that flow in the desired direction on the outlet side 20 from flame arrestor 10 is not undesirably impeded while the reverse flow in the counter-direction into the outlet side 20 is desirably restricted. In order to accomplish this, a reflection suppressor such as suppressor 30, should be configured to taper from base 38 down to vertex 32 along altitude 34.

With reference to FIG. 4, the direction of flow within the pipeline is shown by arrow 40 within inlet pipe 12. Arrow 40 depicts the direction of flow into the inlet side 18 of flame arrestor 10. Flow continues through the internal cavity 11 of flame arrestor 10 containing the fill media and exits flame arrestor 10 through outlet side 20 past reflection suppressor 30 as shown by arrows, collectively 42. Flow continues through outlet pipe 14 and impinges upon restricted end 16.

FIG. 4 is depicted with restricted end 16 for convenience and for test protocol purposes in order to show a reflection directed back toward flame arrestor 10 as depicted by arrow 44. The reflected wave front then travels counter-flow through outlet pipe 14 back toward the outlet side 20 of flame arrestor 10. As shown by arrow 46, the reflected pressure front contacts reflection suppressor 30 through base end 38 and is restricted from reentering the internal cavity 11 of flame arrestor 10. Reflection suppressor 30 then re-deflects the pressure front back toward restricted end 16.

In the case where the material within the pipeline is ignited and traveling through inlet pipe 12, the fill media contained within internal cavity 11 of flame arrestor 10, when acting correctly and as designed, extinguishes the flame in the manner described above. However, the heated combustion gases contained within internal cavity 11 of flame arrestor 10 will exit through outlet side 20 past reflection suppressor 30 creating a pressure head directed down the length of outlet pipe 14. When the high pressure front is reflected by restricted end 16 back toward the outlet side 20 of flame arrestor 10, the reflection suppressor 30, positioned therein restricts the flow of the pressure front back into the internal cavity 11 and reflects it back harmlessly toward restricted end 16 within outlet pipe 14. Reflection suppressor 30 restricts the flow of the high pressure front back into internal cavity 11 which has been otherwise known to cause an over-pressure situation within internal cavity 11 causing flame arrestor 10 to fail which may cause catastrophic results.

As stated above, FIG. 4 depicts a restricted end 16 for the convenience of illustrating the reflection of the pressure front back toward flame arrestor 10 to illustrate the effectiveness of reflection suppressor 30. It is understood, however, that in a pipeline design, reflected pressure wave fronts can be caused by a variety of discontinuities such as a bend in the pipeline, a coupling, a valve and many other such flow-path changes.

A combination of the invention can be used with a wide variety of pipes, for example with pipes having inside diameters ranging from about 2 to about 24 inches. Typically and preferably, the mid-region of the housing of a combination of the invention ranges from about 1.5 to about 4 times the average cross-sectional area of a pipeline with which the combination is associated although larger and smaller such ratios can be employed if desired.

Although the reflection wave suppression capability of a combination of this invention is very useful at relatively low pipe internal gas operating pressures, an inventive combination is particularly advantageous at relatively high pipe internal gas operating pressures, where elevated pressures of dangerous levels can be quickly attained when a flame front and associated pressure wave occur, and the necessity to dissipate or reduce such elevated pressures becomes necessary to avoid catastrophic consequences. So far as is known, no other passive device is known which has the pressure dissipating capacity of the present invention particularly at high operating pipe pressures.

EXAMPLES

A number of tests were conducted using a combination of a flame arrestor with a reflection suppressor in a configuration as illustrated in FIG. 4.

The pipe diameter was 8 inches. The test protocol was as provided in 33 Code of Federal Regulations (CFR) Part 154-Appendix A—"Guidelines for Detonation Flame Arrestors" involving restricted outlet deflagration arrestor testing. The gas mixture was 7% ethylene plus air.

In each of the tests, a flame arrestor, including a crimped ribbon fill media design, was employed with the difference only being the use of the reflection suppressor in Tests 1–10. In these tests, a flame was generated at an ignition point located 20 feet from the inlet side of the flame arrestor. The results of the tests are depicted in Table I. In Table I, Po is the initial pressure, P2 is the maximum final explosion pressure and P2/Po is a calculated pressure ratio. All measured pressures were expressed in absolute psi values. As illustrated, Table I includes a total of seventeen (17) tests, ten (10) with the reflection suppressor of the present invention and seven (7) without. For each test, the pressure (P2) was measured at the inlet side of the flame arrestor.

As reflected in Table I (below), of the ten (10) tests of the flame arrestor including the reflection suppressor of the present invention, the flame arrestor passed. In contrast, as depicted in Tests 11–15, the flame arrestor without the reflection suppressor of the present invention failed in 3 out of 5 tests. In Tests 16 and 17, a different flame arrestor of the same design (as Tests 11–15) was employed in order to be certain that the flame arrestor of Tests 11–15 was not defective. As shown in Table I, Tests 16 and 17, the flame arrestor failed in each test.

TABLE I

| Test No. | Pressure at arrestor (P2) | P2/Po | Pass/Fail | With/Without Reflection Suppressor | Ignition Point*** |
|---|---|---|---|---|---|
| 1 | 35 | 2 | Pass | with | 20 |
| 2 | 51.42 | 3.49 | Pass | with | 20 |
| 3 | 19.19 | 1.3 | Pass | with | 20 |
| 4 | 28.7 | 1.95 | Pass | with | 20 |
| 5 | 16 | 1.23 | Pass | with | 20 |
| 6 | 27.83 | 1.89 | Pass | with | 20 |
| 7 | 39.9 | 2.7 | Pass | with | 20 |
| 8 | 39.7 | 2.7 | Pass | with | 20 |
| 9 | 44.82 | 3.04 | Pass | with | 20 |
| 10 | 37.65 | 2.56 | Pass | with | 20 |
| 11 | 5.27 | 0.35 | Fail | without | 20 |
| 12 | 7.178 | 0.488 | Fail | without | 20 |
| 13 | 25.78 | 1.75 | Pass | without | 20 |
| 14 | 7.178 | 0.488 | Fail | without | 20 |
| 15 | 43.8 | 2.97 | Pass | without | 20 |
| 16* | 22 | 1.5 | Fail | without | 20 |
| 17** | 24 | 1.6 | Fail | without | 20 |

*Same design different arrestor
**Same design different arrestor
***Location 20 forward of this entrance to the flame arrestor/reflection suppressor combination Other and further embodiments, applications, features and the like will be apparent to those skilled in the art.

What is claimed is:

1. A combination of a detonation flame arrestor with a reflection suppressor comprising in combination:

(a) a housing having opposite housing ends with an orifice defined at each opposite end, a mid-region having opposite mid-region ends, each said mid-region end being defined by a transversely extending, apertured wall member, a matrix of elements disposed in said mid-region, which define small channels that extend longitudinally therethrough, a pair of opposite end regions in said housing, each said end region being located between a different one of said orifices and said matrix of elements;

(b) a reflection suppressor having side wall portions that extend between a base portion and an apex portion thereof, a length that is shorter than the distance between said orifice and said matrix of elements in a selected one of said opposite end portions, a cross-sectional area along said length between said base portion and said apex portion that generally declines with increasing distance from said base portion, and said base portion having a cross-sectional area that is less than the cross sectional area of said selected one opposite end region;

(c) mounting means for mounting said reflection suppressor in one of said opposite end regions with said reflection suppressor being centrally positioned in said one opposite end regions with said base portion being located adjacent to said orifice at said one opposite end region;

whereby an advancing flame front with an associated pressure wave can enter the opposed one of said orifices, the flame of said flame front can be suppressed in said mid-region, said pressure wave can pass through said mid-region and around said reflection suppressor and out said orifice, and whereby a reflection wave that propagates back to said orifice strikes said reflection suppressor and is attenuated thereby.

2. The combination of claim 1 wherein said housing is longitudinally elongated.

3. A combination of detonation flame arrestor with reflection suppressor comprising in combination:

(a) a cross-sectionally circular, axially elongated housing having (1) opposite housing ends each with an aperture defined thereat, (2) a diametrically enlarged mid-region of a generally uniform diameter and opposed mid-region ends, (3) a pair of apertured wall members, each one transversely extending across said housing at a different one of said mid-region ends, (4) a matrix of elements disposed in said mid-region which define small, gas conducting channels that extend generally longitudinally through said mid-region and said plate members, (5) a tapered region extending between each said opposite end and one of said apertured wall members;

(b) a tapered body centrally located in one of said tapered regions, said tapered body having a longitudinal length that is less than the axial length of said tapered region;

(1) said tapered body having an apex end and a base end that is longitudinally spaced from said apex end, (2) said base end having a substantially larger cross-sectional area than said apex end, (3) said longitudinal length additionally being such that said base end is located approximately adjacent to said outlet aperture at said one tapered region while said apex end is located approximately adjacent to one of said mid-region ends in said one tapered region, and (c) support means for said housing and said tapered body.

4. The combination of claim 3 wherein said mid-region is charged with a porous, substantially non-compressible, substantially non-combustible flame arrestor fill material.

5. The combination of claim 3 wherein flame arrestor fill material is comprised of an inorganic material.

6. The combination of claim 5 wherein a second tapered body is centrally located in the other of said tapered regions, said second tapered body having a longitudinal length that is less than the axial length of said other tapered region;

(1) said second tapered body having an apex end and a base end that is longitudinally spaced from said apex end, (2) said base end having a substantially larger cross-sectional area than said apex end, (3) said longitudinal length additionally being such that said base end is located approximately adjacent to said outlet aperture at said other tapered region while said apex end is located approximately adjacent to one of said mid-region ends in said other tapered region.

* * * * *

UNITED STATES PATENT AND TRADEMARK OFFICE

CERTIFICATE OF CORRECTION

PATENT NO. : 7,056,114 B2
APPLICATION NO. : 10/664306
DATED : June 6, 2006
INVENTOR(S) : Brooker It is certified that error appears in the above-identified patent and that said Letters Patent is hereby corrected as shown below:

Column 12, line 13, change “5” to -- 3 --

Signed and Sealed this

Twenty-eighth Day of November, 2006

JON W. DUDAS
*Director of the United States Patent and Trademark Office*